US008794856B2

(12) United States Patent
Thiemann et al.

(10) Patent No.: US 8,794,856 B2
(45) Date of Patent: Aug. 5, 2014

(54) DEVICE FOR SAMPLING A WEB MOVEMENT, PRINTING SYSTEM AND METHOD FOR CONTROLLING A PROCESSING OPERATION

(75) Inventors: Peter Thiemann, Munich (DE); Stephan Pilsl, Rohrmoos (DE)

(73) Assignee: Océ Printing Systems GmbH, Poing (DE)

( * ) Notice: Subject to any disclaimer, the term of this patent is extended or adjusted under 35 U.S.C. 154(b) by 210 days.

(21) Appl. No.: 13/391,224

(22) PCT Filed: Aug. 20, 2010

(86) PCT No.: PCT/EP2010/062139
§ 371 (c)(1),
(2), (4) Date: Feb. 17, 2012

(87) PCT Pub. No.: WO2011/020903
PCT Pub. Date: Feb. 24, 2011

(65) Prior Publication Data

US 2012/0148324 A1 Jun. 14, 2012

(30) Foreign Application Priority Data

Aug. 21, 2009 (DE) ..... 10 2009 038 480

(51) Int. Cl.

| | |
|---|---|
| ***B41J 15/00*** | (2006.01) |
| ***G03G 15/00*** | (2006.01) |
| ***B65H 26/00*** | (2006.01) |
| ***B41J 11/42*** | (2006.01) |

(52) U.S. Cl.
CPC ..... *B41J 11/425* (2013.01); *B65H 23/1885* (2013.01)
USPC ..... 400/611; 399/84; 226/45

(58) Field of Classification Search
CPC ..... B65H 23/18; B65H 23/1882; B65H 23/1884; B65H 23/192; B65H 23/04; B65H 23/046; B41J 11/425
USPC ..... 226/45; 400/611
See application file for complete search history.

(56) References Cited

U.S. PATENT DOCUMENTS 4,070,951 A 1/1978 Bala
4,091,913 A * 5/1978 Ku et al. ..... 400/703

(Continued)

FOREIGN PATENT DOCUMENTS

JP 2611226 2/1997
WO 9315008 8/1993

OTHER PUBLICATIONS

LSI/CSI—Backlash Compensation with LS7083 in Unidirectional Motion Controllers, Application Note 601, LSI Computer Systems, Inc., Dec. 1996—2 page.

*Primary Examiner* — Daniel J Colilla
*Assistant Examiner* — John M Royston
(74) *Attorney, Agent, or Firm* — Schiff Hardin LLP

(57) ABSTRACT

In a method or device to sample a web movement, an incremental encoder translates the web movement into two phase-offset output signals. A quadrature decoder generates first and second digital output signals with two respective signal levels. The first output signal is designated as a forward signal and the second output signal is designated as a backward signal. An evaluation circuit outputs a control signal and has a first counter that counts a signal change of the forward signal and subtracts from the count a signal change of the backward signal. A second counter counts a signal change of the control signal. A comparator compares values of the first and the second counters. A disabling device enables the forward signal if values of both the first and second counters are the same so that the forward signal is output, and disables the forward signal if values of the two counters are different.

6 Claims, 3 Drawing Sheets

(56) References Cited

U.S. PATENT DOCUMENTS

| | | | | | |
|---|---|---|---|---|---|
| 4,359,675 | A | | 11/1982 | Miller, III | |
| 4,366,372 | A | * | 12/1982 | Sargent | 377/3 |
| 4,366,753 | A | | 1/1983 | Glanz et al. | |
| 4,373,266 | A | * | 2/1983 | Stutz | 33/735 |
| 4,561,103 | A | * | 12/1985 | Horiguchi et al. | 382/112 |
| 4,665,353 | A | * | 5/1987 | Salazar et al. | 318/599 |
| 4,719,575 | A | * | 1/1988 | Gnuechtel | 700/122 |
| 5,021,781 | A | * | 6/1991 | Salazar et al. | 341/13 |
| 5,187,479 | A | | 2/1993 | Johnson, III et al. | |
| 6,046,427 | A | * | 4/2000 | Richter et al. | 219/121.67 |
| 7,178,460 | B2 | * | 2/2007 | Markert | 101/182 |
| 2004/0197127 | A1 | | 10/2004 | Shibata et al. | |

* cited by examiner

DEVICE FOR SAMPLING A WEB MOVEMENT, PRINTING SYSTEM AND METHOD FOR CONTROLLING A PROCESSING OPERATION

BACKGROUND

The present disclosure concerns a device to sample a web movement of a material web, a printing system that uses such a device, and a method to control a handling process.

Printing systems to print web-shaped recording material have long been known. Such printing systems normally have a device to scan the web movement. These devices typically comprise a free-wheeling roller that is in contact with the web-shaped recording material and translates the linear motion of the recording material into a rotary motion. The roller is coupled to an incremental encoder. The incremental encoder translates the rotary motion of the roller into a (normally electrical) control signal. Different types of incremental encoders are known. On the one hand, they differ in the manner of sampling. There are thus incremental encoders that photoelectrically scan the line pattern applied on a disc. There are incremental encoders that sample a rotating magnetic pattern and which operate by means of slip contacts. There are even incremental encoders that output a directional signal. Such incremental encoders generate two phase-offset output signals that are translated via a corresponding post-processing into a movement signal and a direction signal. Alternatively, the two phase-offset output signals can also be converted by means of commercially available quadrature decoders into one signal that is only generated given movement in one direction and into an additional signal that is generated only given movement in the other direction.

The movement of a web-shaped material web can be sampled with such incremental encoders. These incremental encoders are used to sample the motion of a web-shaped recording material in printing systems. However, they are also used to sample the motion of other material webs and conveyor belts in production facilities.

In principle, in printing systems and in production systems there exists the need to increase the speed of the web movement. The higher the rated speed of a web, the more complicated the activation or deactivation of the corresponding system since such a web must be accelerated gradually up to the rated speed upon activation and must be braked gradually upon deactivation. The control of the speed of the web takes place by means of a control signal provided by a central control device, which control signal is typically a digital, pulsed signal. This signal provides the speed of the web. Since the movement of the web is subject to a significant inertia of the material and of the rollers that are in contact with this, the actual speed of the web deviates from the speed provided by the control signal often markedly from the desired speed, primarily upon running up and braking the web.

Since the additional processes that are connected with the web speed—for example the printing of the web shaped recording material or other handling and processing processes of a material web—are also controlled by means of the control signal output by the central control device, the production or the printing process is normally deactivated upon acceleration or upon braking of the web. Spoilage of unprocessed material web (recording material) is hereby generated, what is known as maculature. The higher the rated speed of the material web, the longer that the run-up or braking of the material web takes, and the larger the corresponding quantity of maculature as well.

SUMMARY

It is an object to achieve a device to sample a web movement of a material web, a printing system, and a method to control a printing process with which it is possible to operate the material web with a high rated speed, wherein at the same time the spoilage generated by the run-up or braking of the material web is kept to a low level.

In a method or device to sample a web movement of a material web, an incremental encoder translates the web movement into two phase-offset output signals. A quadrature decoder generates first and second digital output signals with two respective signal levels, the first output signal being generating only given a forward motion of the material web and the second output signal being generated only given a backward motion of the material web, every change between the signal levels corresponding to a web movement of a defined displacement, and wherein the first output signal is designated as a forward signal and the second output signal is designated as a backward signal. An evaluation circuit outputs a control signal and has a first counter that counts a signal change of the forward signal and subtracts from the count a signal change of the backward signal. A second counter counts a signal change of the control signal. A comparator compares values of the first and the second counters. A disabling device enables the forward signal if the values of both of the first and second counters are the same so that the forward signal is output, and disables the forward signal if the values of the two counters are different.

DESCRIPTION OF PREFERRED EXEMPLARY EMBODIMENT

Figure 1:
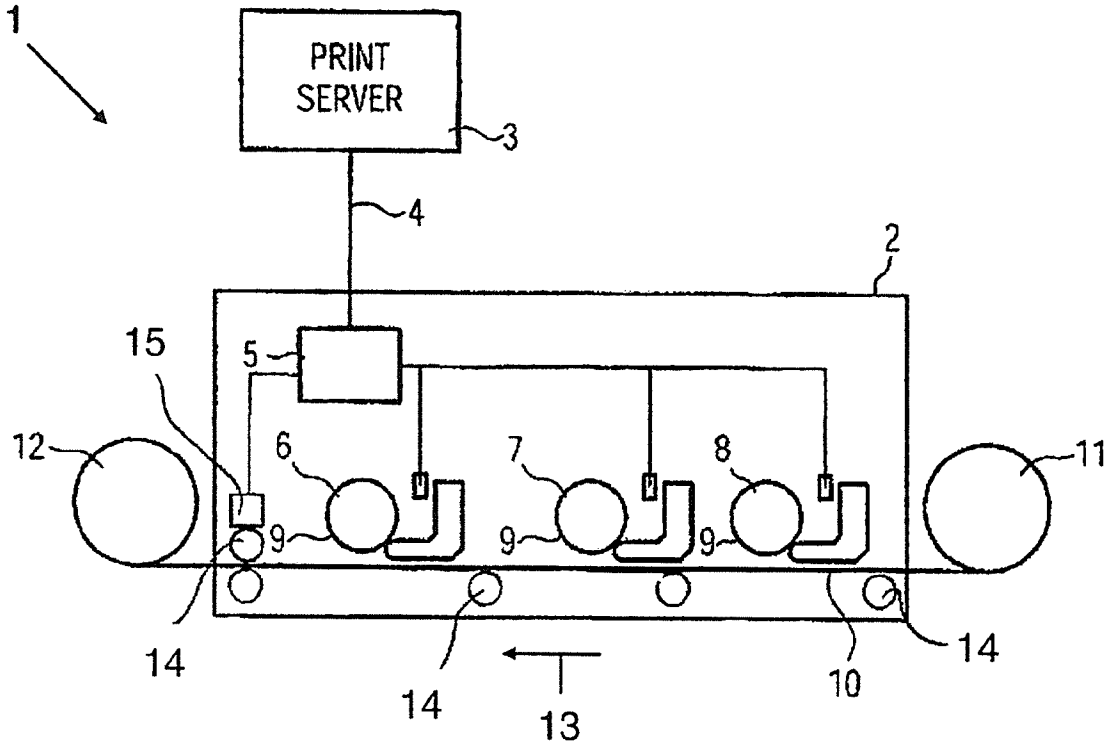
FIG. 1 schematically, a printing system according to the invention in a block diagram, FIG. 2 a position/time coordinate system, together with the corresponding signals, and FIG. 3 the device according to the invention to sample a web movement, schematically in a block diagram.

For the purposes of promoting an understanding of the principles of the invention, reference will now be made to a preferred exemplary embodiment/best mode illustrated in the drawings and specific language will be used to describe the same. It will nevertheless be understood that no limitation of the scope of the invention is thereby intended, and such alterations and further modifications in the illustrated embodiment and such further applications of the principles of the invention as illustrated as would normally occur to one skilled in the art to which the invention relates are included.

A device according to the preferred embodiment to sample a web movement of a material web comprises an incremental encoder to translate the web movement into two phase-offset output signals and a quadrature decoder to generate two digital output signals with two respective signal levels, wherein one of the output signals is generated only given a forward motion of the web and the other of the output signals is generated only given a backward motion of the web. Every change between the signal levels corresponds to a web movement of a defined displacement. The signals are designated in the following as a forward signal and a backward signal. Furthermore, it comprises an evaluation circuit to output a control signal with a first counter that counts the signal change of the forward signal and subtracts from this the signal change of the backward signal; a second counter that counts the signal change of the control signal; a comparator that compares the values of the first and second counter with one another; and a disabling device that enables the forward signal if the values of both counters are the same so that the forward signal is output as a control signal (enabled), and disables the forward signal if the values of the two counters are different (disabled). In particular, no control signal is thereby output. It is thereby conceivable to output a constant signal and/or a logical signal, for example a constant logical NO or a constant logical YES (in particular by interposing an inverter).

The preferred embodiment is based on the realization that material webs in a production process—for example a printing system—are only moved in one handling direction for handling, which handling direction represents the forward direction in the following. It is hereby possible to not output an unintentional backward motion (which backward motion repeatedly occurs during a pause of the web, however) with regard to the activation of the handling and processing processes of the material web (in particular the printing of a web-shaped recording material) as a control signal, such that no unwanted handling processes are initiated. However, such a backward motion must be taken into account again at the following forward motion since the additional handling and processing processes should only be resumed again when the material web is located at the position before the backward motion.

With a device according to the preferred embodiment and to sample a web movement, this can be produced in that a first counter is used that counts the signal change of the forward signal and subtracts from this the signal change of the backward signal. The value of this counter corresponds to the absolute position of the web including the unintended motion during the pause of the web. The second counter counts the signal change of the control signal. The value of the second counter thus corresponds to the web position output by the control signal, which web position is based solely on a forward movement. By comparing the two values of the counters when a deviation of the two counters states from one another is established, this is interpreted as a state in which the material web has unintentionally been moved back a bit. When the backward movement of the material web is compensated again via a corresponding forward movement, the two counters again have the same value. The forward signal is output as a control signal given an additional forward movement. A printing system according to the preferred embodiment is designed with such a device to control the placement of the printing medium on a web shaped recording material.

In a method according to the preferred embodiment to control a handling process of a material web, a) a movement of the material web is translated into two phase-offset output signals with an incremental encoder, b) two digital output signals with two respective signal levels are generated from the two phase-offset output signals by means of a quadrature decoder, wherein one of the signals is generated only given a forward motion of the material web and the other of the output signals is generated only given a backward motion of the material web, and each change between the signal level corresponds to a web movement of a defined displacement, wherein the signals are designated in the following as forward signal and backward signal, c) to output a control signal via an evaluation circuit the signal changes of the forward signal are counted with a first counter, and the signal changes of the backward signal are subtracted from this, the signal changes of the control signal are counted with a second counter, the values of the first and second counters are compared with one another with a comparator, and the forward signal is enabled with a disabler device if the values of the two counters are the same, such that the forward signal is output as a control signal, and if the values of the two counters are different the forward signal is blocked.

and d) the generated control signal is used to control the handling of the material web.

In particular, no control signal is output if the forward signal is blocked. As was already described further above with regard to the device according to the preferred embodiment, it is thereby possible to output a constant signal and/or a logical signal.

In particular, given a method according to the preferred embodiment to control a printing process a device described above can be used to sample a web movement, wherein the control signal generated by the device is used to activate a print group to print the material web (in particular a web-shaped recording material) with a printing medium (for example with a toner or an ink) in a printing apparatus or printing process.

In particular, the following problems can be solved with the preferred embodiment:

If it is desired that the production not be deactivated during the run-up or braking of the material web, the individual handling and processing processes could then be synchronized exactly with the web movement or the actual speed of the material web. For this the actual movement of the material web during the run-up and braking of the same would have to be detected, and this signal would have to be used to control the additional processes. If a conventional incremental encoder is used for this, the actual speed of the material web can then also be detected exactly during the run-up and braking, and the corresponding processes can then be controlled.

However, such a control of the processes at a moving material web by means of a movement signal detected by an incremental encoder causes additional problems. These are primarily in the area of the pause of the material web. If a material web is stopped and the desired speed amounts to zero, this does not mean that the material web is then perfectly at rest. The material web can move somewhat due to temperature fluctuations, vibrations and the like. If this movement were to be sampled with an incremental encoder with which the smallest movements in the range of a few 10ths of a mm can already be detected, the additional processes would be activated and an unintentional handling and processing of the material web would occur. On the other hand it is also undesirable to deactivate the sensor to sample the movement of the material web during the pause of the material web, because then a slight motion of the material web caused by the environmental conditions in the pause of the material web could not be detected. This would have the result that handling processes that must be controlled precisely with regard to the material web would exhibit an offset relative to one another before and after the pause of the material web. Even such a slight offset can lead to a spoilage of the product. This in particular applies to print images, in which an offset of a few μm is perceptible to the observer.

In the preferred embodiment, to sample a web movement a printing process can be controlled such that the printing process is continuously carried on during the run-up or during the braking, even at a high rated speed. It is also possible to continue to print on the web-shaped recording material without interruption after halting the printing system. It has been shown that the recording material can be halted in a position in which a print head is located within a print image. No distortion has resulted in the print image due to the halt process.

The amount of maculature can be significantly reduced with the preferred embodiment. The development of the device to sample a web movement of a material web is very simple and can be realized cost-effectively relative to a conventional incremental encoder. A completely new control principle to control a handling process—in particular a printing process—can be applied with this simple development, namely in that the process is controlled using the control signal generated by the device to sample the web movement of the material web, and not using a control signal imposed from the outside by a central control device.

The preferred embodiment is explained in detail in the following using the drawings.

FIG. 1 shows a printing system 1 designed according to the preferred embodiment. This printing system 1 comprises a printing apparatus 2, a print server 3 to which the printing apparatus 2 is connected by means of a data line 4. In the printing apparatus 2, the data line 4 terminates at a Scalable Raster Architecture (SRA) print data controller 5 that rasters the print jobs into individual image points. The rastered print data are supplied to the three print groups 6, 7, 8 at which they generate a latent image on a photoconductor drum 9. Three different colors can be printed with the three print groups. The electrostatic images that are created in this manner are then electrophotographically developed with toner in a known manner and transferred to a recording material 10.

The recording material 10 is a paper web that is unrolled from an input roller 11 and rolled up on an output roller 12.

The web-shaped recording material is moved in a transport direction 13 along a transport path 10. The transport path is defined by rollers 14 that are arranged above and below the transport path. One of the rollers 14 is provided with a device 15 according to the preferred embodiment to sample the web movement. This device 15 is designated in the following as a sampling device 15 and is explained in detail below. The sampling device 15 generates a control signal that is relayed via the print data controller 5 to the individual print groups 6, 7, 8.

This printing system 1 is suitable both for single color, highlight color, and full color printing. In particular, this printing system is suitable for digital printing, which in particular comprises electrophotographic printing methods and inkjet printing methods. In inkjet printing methods, the print groups 6, 7, 8 are designed as inkjet print heads.

The sampling device 15 comprises an incremental encoder 16 that generates two phase-offset output signals. The output signals are converted by means of a differential receiver 17 into TTL levels. The output signals translated into TTL levels in such a manner are supplied to a quadrature decoder 18. Such a quadrature decoder is, for example, commercially available under the trade name LS 7083 from the US Digital Corporation, Vancouver, Wash., USA. The output signals received from the incremental encoder are translated with this quadrature decoder 18 into two digital output signals up or dn. These two digital output signals respectively have two signal levels, wherein one of the two output signals (up) is generated only given a forward movement of the web and the other of the two output signals (dn) is generated only given a backwards movement of the web. Every change between the signal levels means that the material web has traveled a defined distance in the corresponding direction. The output signal for the forward movement is designated as the forward signal (up), and the output signal for the backward movement is designated as the backward signal (dn). The forward movement corresponds to the transport direction 13, such that the forward signal (up) describes the movement of the material web in the transport direction 13.

This arrangement of incremental encoder 16 with two phase-offset signals, a differential receiver 17, and a quadrature decoder 18 is known per se.

An evaluation circuit is downstream of the quadrature decoder 18. The evaluation circuit has a first counter 20 that is provided with two inputs. The forward signal up output by the quadrature decoder 18 is present at the first input, and the backward signal dn is present at the second input. The first counter 20 is designed such that every change of the signal level of the forward signal increases the value of the counter by 1 and every change of the signal level of the backward signal reduces the value of the counter by 1.

The evaluation circuit has a second counter 21 at whose input is present the control signal up* to be generated by the sampling device 15. The second counter counts the change of the signal level of the control signal up*. The outputs of the two counters 20, 21 are supplied to a comparator 22. The comparator 22 generates a logical NO if the values of the two counters 20, 21 are the same and a logical YES if the two values differ. An inverter 23 that inverts the output of the comparator 22 is subordinate to the comparator 22.

From the inverter 23, a data line leads to a latch 24 to which the output signal of the comparator 22 (inverted by the inverter 23) is supplied as an input signal. The latch 24 has a trigger input to which the forward signal is supplied via an additional inverter 25. If a logical "NO" is present at the trigger input, the latch 24 then relays the signal present at its input to the output. The output of the latch 24 is connected with an AND gate 26. The forward signal up of the quadrature decoder 18 is present at the additional input of the AND gate 26. The output of the AND gate 26 forms the control signal up* that is directed to the print data controller 5 and to the input of the first counter 20.

Since the signal input of the latch 24 is relayed to the AND gate 26 given a logical NO at the trigger input of the latch 24, given a logical YES of the forward signal the inverted output signal of the comparator is applied at the AND gate 26.

If the two counters 20, 21 have the same value, the inverted output signal of the comparator 22 is a logical YES, such that a logical YES signal is present at both inputs of the AND gate 26 given the same counter state and given a logical YES of the forward signal. The AND gate hereby also generates a logical YES at the output. If the forward signal transitions to a logical NO, on the one hand the latch 24 is blocked by the trigger input so that a logical NO is also present at its output, and on the other hand the logical NO of the forward signal is present at the second input of the AND gate 26. The AND gate 26 hereby generates a logical NO at the output. The output of the AND gate 26 thus represents an exact depiction of the forward signal when the values of the two counters 20, 21 are the same.

If the two values of the counters 20, 21 differ, the comparator 22 then generates a logical YES that is inverted by the inverter 23 to a logical NO. A logical NO is thus present at the output of the latch 24, independent of which signal is present at the trigger input of the latch 24. A logical NO is therefore present at the input of the AND gate 26 that is connected with the latch 24, whereby the output of the AND gate is a logical NO. This is independent of what signal is present at the additional input of the AND gate 26 that is connected with the quadrature decoder 18. If the values of the two counters 20, 21 differ, the control signal up* is a constant logical NO. The forward signal up of the quadrature decoder 18 is thus blocked at the AND gate 26. The AND gate 26 thus represents a blocking device to block the forward signal (up) as a control signal (up*) when the values of the two counters 20, 21 differ.

Figure 3:
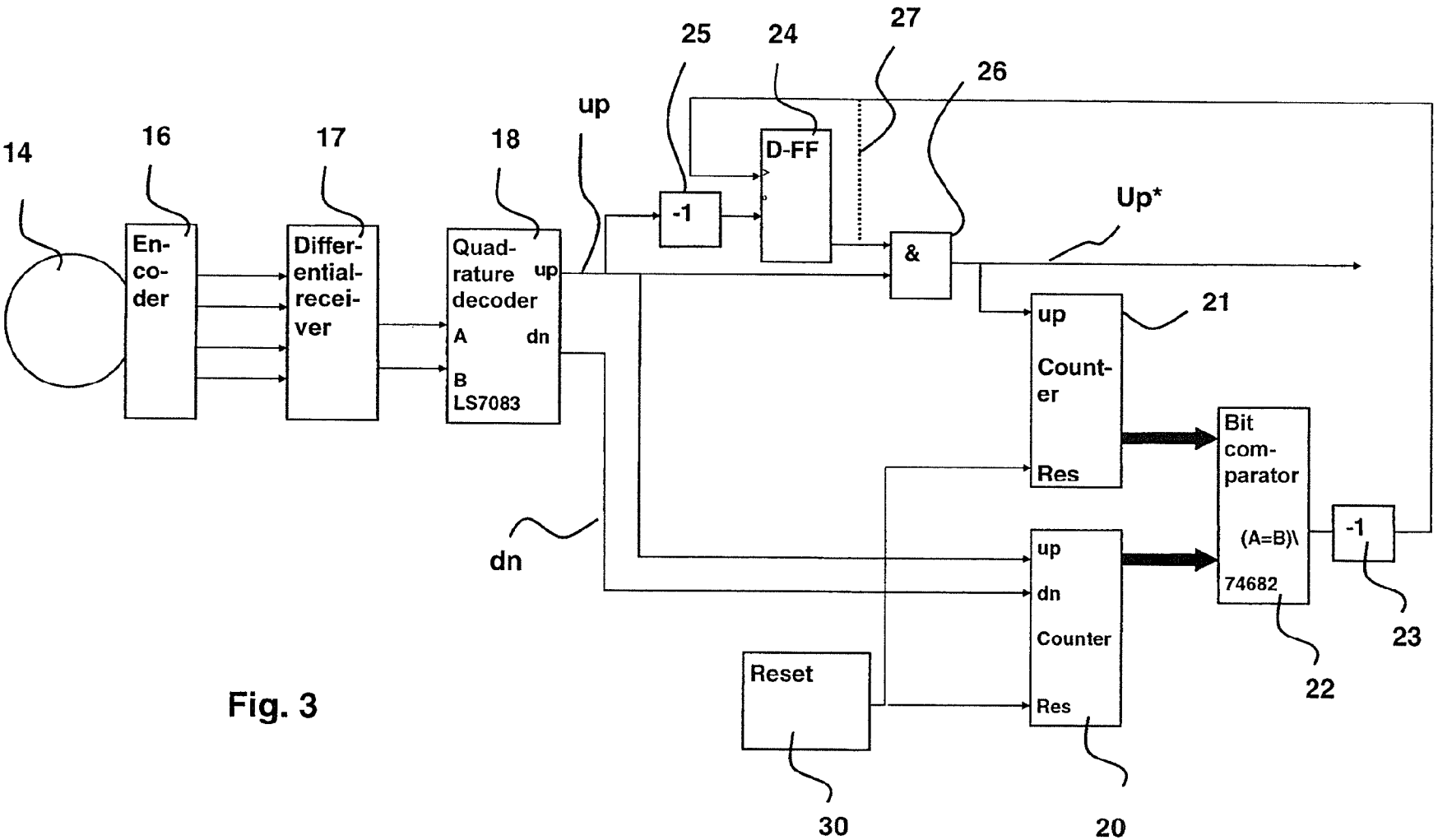

In principle, to bring about this function the latch 24 and the inverter 25 can be omitted, and the inverted output of the comparator can be directly connected with the input of the AND gate via the data line 27 (shown in FIG. 3 with the unbroken line).

The use of the latch 24 ensures that, given a change of the output signal of the comparator 22 if the counters are the same, two logical YESses are not already present at the AND gate 26 (thus an incorrect control signal would be generated).

Figure 2:
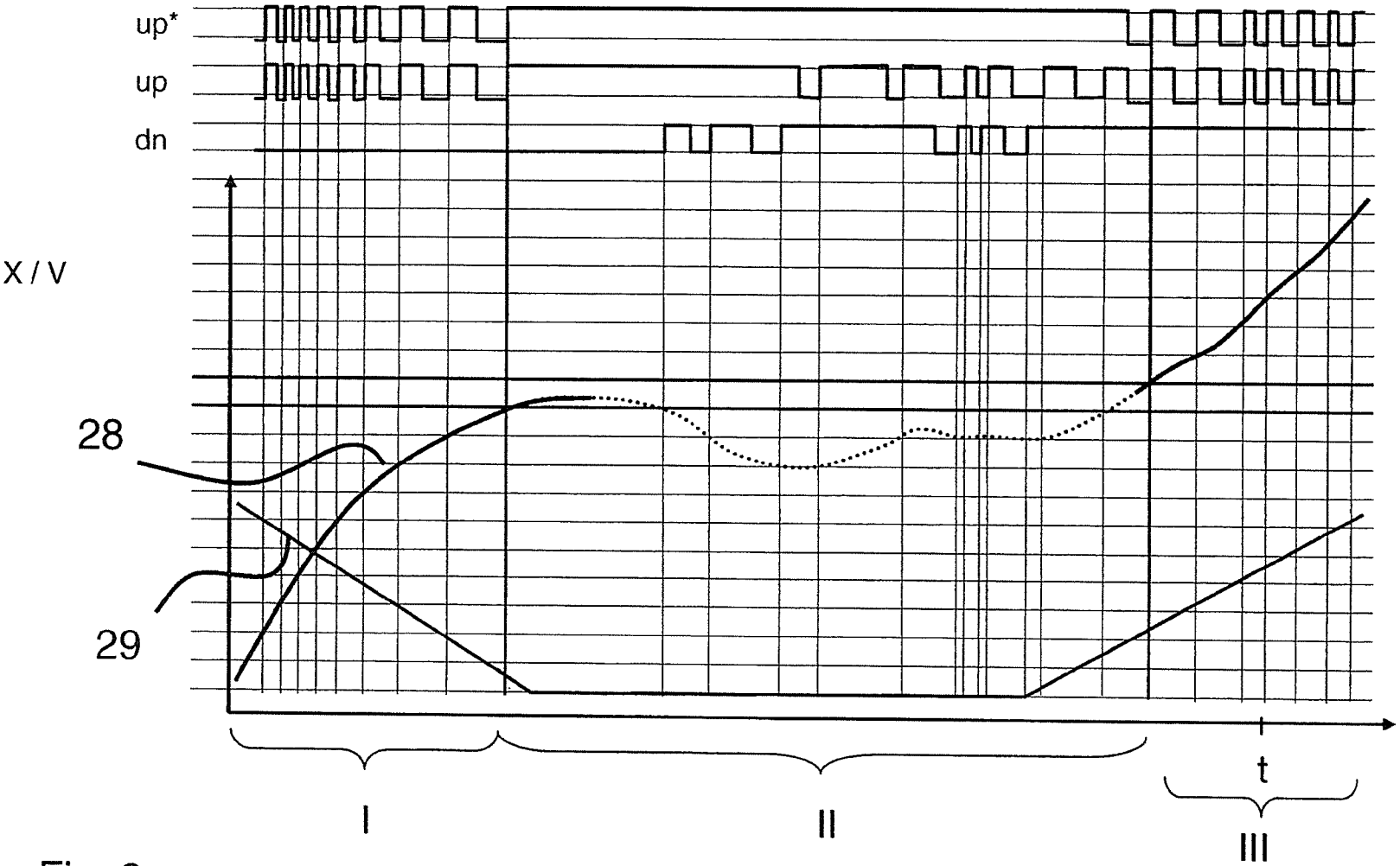

Since the first counter 20 both counts the signal change of the forward signal up and subtracts the signal change of the backward signal do from the value, the value of the first counter 20 corresponds to the total movement of the recording material both in the transport direction 13 and counter to the transport direction 13. FIG. 2 shows the curve of the position x of the recording material relative to the time t using line 28 in a position/time coordinate system. In addition to this, in the coordinate system the desired speed v is plotted with the line 29.

In a first section I, the movement of the recording material is delayed. In this section the forward signal up shown above the coordinate system contains successive signal changes whose interval increases due to the delay. The control signal up* in this section coincides with the forward signal up. In the following section II, the desired speed amounts to zero, meaning that the recording material should be at rest. However, due to external influences there is a movement of the recording material. Given a backward movement, signal changes are generated in the backward signal dn. At the end of the section II, an acceleration of the recording material in the transport direction 13 takes place. The recording material is hereby moved in the forward direction and corresponding signal changes are generated in the forward signal. If the number of signal changes of the forward signal coincides with that of the previously occurred signal changes of the backward signal, in the first counter 20 a value is again reached that corresponds to the value of the counter before the backward movement of the recording material was introduced.

Since no additional signal changes are supplied to the input of the second counter 21 as of the backward movement as of which the values of the two counters differ, the second counter 21 registers neither the signal changes of the backward signal nor the following signal changes of the forward signal. Only when the two counters 20, 21 again contain the same value, which is the case when exactly as many signal changes of the forward signal up follow the signal changes of the backward signal dn. This means that, as of the moment at which the web or the recording material has again exactly assumed be positioned before the backward movement, the identical state in the two counters is achieved and the forward signal is again output as control signal up*.

The two counters 20, 21 have a reset input that is connected with a reset control element 30. If the sampling device 15 is started up and connected to live current, the reset control element 30 generates a reset of the two counters 20, 21 so that both counters have the same value at the beginning.

The counters used in the present exemplary embodiment are 12-bit counters. Given a travel resolution of the sampling device 15 of 43 μm, this means that the values of the two counters can deviate by a maximum count value of 4096 without an error occurring. This corresponds to a travel length of 173 mm. Given a higher spatial resolution (of 5 μm, for example), it is appropriate to use a counter with more digits, for example a 16-bit counter.

It has been shown that the sampling device 15 according to the preferred embodiment allows a handling process even given slowing and acceleration of the material web. In a full color printing system, the printing process was halted at an arbitrary point and then resumed again. The whole position was undetectable in the print product, even if this had been vibrated by having a person jumping next to the printing apparatus.

The control signal generated with the sampling device 15 is supplied via the print data controller 5 to the individual print groups 6, 7, 8 in order to control the printing of the recording material with the corresponding color. This control signal thus serves to control the handling and processing processes to be executed at the material web. In addition to the printing, these can also be additional handling processes, for example perforating, punching or coating. A method is thus achieved that does not adjust the movement of the material web and all handling and processing processes according to an external control signal; rather the movement of the material web is controlled corresponding to the specification of an external control signal, but the additional handling and processing processes are controlled depending on the control signal sampled by means of the sampling device 15, which control signal reflects the position of the material web.

The use of the sampling device 15 in principle allows an arbitrarily fine spatial resolution without errors in the control being caused by this. An arbitrary spatial resolution adapted to the individual handling and processing processes by means of the control signal can thus be provided.

The evaluation circuit also functions given an overflow of the counters since only the deviation of the two counters—which deviation is similarly maintained given an overflow of one or both counters—is of importance to the function.

The method according to the preferred embodiment is primarily provided to control a printing process. However it can also be applied to other production systems in which a material web is conveyed in a predefined transport direction for handling and processing.

The preferred embodiment has been explained above using an exemplary embodiment in which every signal change of the forward signal and of the backward signal corresponds to a defined path of the web movement in the forward or backward direction. Within the scope of the present preferred embodiment, it is naturally possible to not evaluate every signal change but rather every second signal change, for example. For example, this would have the result that only rising or only falling edges of the signals are counted and evaluated. Such an embodiment can also be described in that it is not signal changes that are detected and counted but rather pulses of the forward signal and of the backward signal. However, this hardly changes anything as a result other than that the resolution is reduced.

The method explained above concerns a printing process. However, the method according to the preferred embodiment can also be used in other production systems in which a moving material web is handled or processed, wherein the individual handling and processing processes should have an effect at defined locations of the material web. With the method according to the preferred embodiment, the defined locations of the material web can be controlled exactly or the point in time when the handling or processing processes are to be executed on the passing material web can be defined. All printing types can be used for the printing process, i.e. even methods based on the liquid print media such as inkjet printing methods (inkjet method) or toner-based electrographic methods with liquid developer, offset printing methods, magnetographic printing methods, ionographic printing methods etc., for example.

The preferred embodiment can briefly be summarized as follows:

An incremental encoder is used to sample the web movement of the material web in a handling process (in particular a printing process), wherein given a backward movement of the material web that is not provided per se the output of the signals generated by means of the incremental encoder is suppressed, and these are only output again when a forward movement follows the backward movement, wherein the path of the forward movement corresponds to the path of the previously executed backward movement of the material web. Only after this are control signals corresponding to the signals output.

Although preferred exemplary embodiment is shown and described in detail in the drawings and in the preceding specification, it should be viewed as purely exemplary and not as limiting the invention. It is noted that only preferred exemplary embodiment is shown and described, and all variations and modifications that presently or in the future lie within the protective scope of the invention should be protected.

We claim as our invention:

1. A device to sample a web movement of a material web, comprising:

an incremental encoder to translate the web movement into two phase-offset output signals;

a quadrature decoder to generate first and second digital output signals with two respective signal levels, wherein the first output signal is generated only given a forward motion of the material web and the second output signal is generated only given a backward motion of the material web, and every change between the signal levels corresponds to a web movement of a defined displacement, the first output signal being designated as a forward signal and the second output signal being designated as a backward signal;

an evaluation circuit to output a control signal, said evaluation circuit comprising a first counter that counts a signal change of the forward signal and subtracts from the count a signal change of the backward signal, a second counter that counts a signal change of the control signal, a comparator that compares values of the first and the second counters with one another, and a disabling device that enables the forward signal if the values of both of the first and second counters are the same so that the forward signal is output as said control signal and disables said forward signal if the values of the two counters are different;

the disabling device being designed as an AND gate, and wherein the forward signal and an output signal of the comparator are present at first and second inputs of the AND gate such that it is set such that said comparator output signal is a logical YES given same values of the first and second counters, and given different values the output signal is a logical NO;

a latch being provided between the comparator and the disabling device and via said latch two logical YESses are not already present at the disabling device given a change of the output signal of the comparator if the first counter and the second counter are the same;

an inverter subordinate to the comparator and directing a data line from the inverter to the latch to which the output signal of the comparator that is inverted by the inverter is supplied as an input signal;

the latch having a trigger input to which the forward signal is supplied via an additional inverter wherein the latch relays the input signal present at its input to its output when a logical "NO" is present at the trigger input;

the output of the latch being connected with a first input of the disabling device, the disabling device being another AND gate, and the forward signal being present at the second input of said AND gate;

the output of the AND gate forming the control signal that is directed to the input of the second counter; and the control signal being directed from the output of the AND gate to a print data controller of a printing system in order to control printing of said material web as a recording material.

2. The device according to claim 1 wherein the incremental encoder is connected with a roller along which the material web is moved.

3. The device according to claim 1 wherein the incremental encoder is designed such that the signal changes of the forward signal and of the backward signal respectively correspond to a movement of the material web in a range of 2 μm to 100 μm.

4. The device according to claim 1 wherein the counters comprise 12-bit counters.

5. A printing system, comprising:

at least one print group to print a web-shaped recording material and a print data controller that processes print data and supplies the print data to the print group; and the printing system having a device to control a printing process in the print group, said device comprising an incremental encoder to translate the web movement into two phase-offset output signals;

a quadrature decoder to generate first and second digital output signals with two respective signal levels, wherein the first output signal is generated only given a forward motion of the material web and the second output signal is generated only given a backward motion of the material web, and every change between the signal levels corresponds to a web movement of a defined displacement, the first output signal being designated as a forward signal and the second output signal being designated as a backward signal;

an evaluation circuit to output a control signal, said evaluation circuit comprising a first counter that counts a signal change of the forward signal and subtracts from the count a signal change of the backward signal, a second counter that counts a signal change of the control signal, a comparator that compares values of the first and the second counters with one another, and a disabling device that enables the forward signal if the values of both of the first and second counters are the same so that the forward signal is output as said control signal and disables said forward signal if the values of the two counters are different;

the disabling device being designed as an AND gate, and wherein the forward signal and an output signal of the comparator are present at first and second inputs of the AND gate such that it is set such that said comparator output signal is a logical YES given same values of the first and second counters, and given different values the output signal is a logical NO;

a latch being provided between the comparator and the disabling device and via said latch two logical YESses are not already present at the disabling device given a change of the output signal of the comparator if the first counter and the second counter are the same;

an inverter subordinate to the comparator and directing a data line from the inverter to the latch to which the output signal of the comparator that is inverted by the inverter is supplied as an input signal;

the latch having a trigger input to which the forward signal is supplied via an additional inverter wherein the latch relays the input signal present at its input to its output when a logical "NO" is present at the trigger input;

the output of the latch being connected with a first input of the disabling device, the disabling device being another AND gate, and the forward signal being present at the second input of said AND gate;

the output of the AND gate forming the control signal that is directed to the input of the second counter; and the control signal being directed from the output of the AND gate to the print data controller of the printing system in order to control printing of said material web as the recording material.

6. The printing system according to claim 5 further comprising a plurality of said print groups to print the recording material with different colors.

* * * * *